US005373872A

United States Patent [19]

Mueller

[11] Patent Number: 5,373,872

[45] Date of Patent: Dec. 20, 1994

[54] APPARATUS AND METHOD TO PROVIDE BAG-IN-A-BOX SYSTEM

[75] Inventor: Alfred F. Mueller, Neshanic Station, N.J.

[73] Assignee: International Flavors & Fragrances Inc., New York, N.Y.

[21] Appl. No.: 84,075

[22] Filed: Jun. 30, 1993

[51] Int. Cl.[5] ..... B65B 1/04; B65B 3/00

[52] U.S. Cl. ..... 141/10; 141/11; 141/48; 141/63; 141/85; 141/92; 141/314; 141/392; 81/3.4; 215/295

[58] Field of Search ..... 141/10, 11, 18, 21, 141/47, 48, 63, 85, 91, 92, 313, 314, 392; 222/148, 541, 105; 81/3.07, 3.4; 7/151; 215/295, 296, 298, 302, 303, 253, 254; 422/26, 302

[56] References Cited

U.S. PATENT DOCUMENTS

| | | | |
|---|---|---|---|
| Re. 32,354 | 2/1987 | Savage | 222/81 |
| 2,477,406 | 7/1949 | Church | 141/51 |
| 3,516,452 | 6/1970 | Scholle | 141/18 |
| 3,894,381 | 7/1975 | Christine et al. | 53/128 |
| 4,105,139 | 8/1978 | Scholle | 222/105 |
| 4,257,535 | 3/1981 | Mellett | 141/18 |
| 4,331,266 | 5/1982 | Bond | 222/107 |
| 4,351,455 | 9/1982 | Bond | 222/153 |
| 4,362,255 | 12/1982 | Bond | 222/107 |
| 4,380,310 | 4/1983 | Schneiter et al. | 222/501 |
| 4,440,316 | 4/1984 | Christine | 222/83.5 |
| 4,445,550 | 5/1984 | Davis et al. | 141/329 |
| 4,458,734 | 7/1984 | Scholle et al. | 141/5 |
| 4,478,242 | 10/1984 | Bond | 137/383 |
| 4,601,410 | 7/1986 | Bond | 222/92 |
| 4,682,702 | 7/1987 | Gach | 215/254 |
| 4,711,380 | 12/1987 | Ulm | 222/541 |
| 4,767,478 | 8/1988 | Christine | 156/69 |
| 4,796,788 | 1/1989 | Bond | 222/94 |
| 4,883,201 | 11/1989 | Poulton | 222/105 |
| 4,953,729 | 9/1990 | Kloosterhouse | 222/541 |
| 4,999,978 | 3/1991 | Kohlbach et al. | 141/48 |
| 5,037,002 | 8/1991 | Tschanen | 222/105 |
| 5,129,212 | 7/1992 | Duffey et al. | 53/426 |
| 5,246,126 | 9/1993 | Lewis, Jr. | 215/303 |

FOREIGN PATENT DOCUMENTS

| | | |
|---|---|---|
| 0190757 | 8/1986 | European Pat. Off. . |
| 366269 | 2/1990 | European Pat. Off. . |
| 3503916 | 8/1986 | Germany . |
| 3534810 | 4/1987 | Germany . |
| 3615063 | 11/1987 | Germany . |

OTHER PUBLICATIONS

English language Translation of German Patent DE 350 3916 Aug. 7, 1986.

English language Translation of German Patent OLS 35 34810 Apr. 16, 1987.

*Primary Examiner*—Henry J. Recla

*Assistant Examiner*—Steven O. Douglas

*Attorney, Agent, or Firm*—Arthur L. Liberman

[57] ABSTRACT

A fitment device is disclosed to be used with a "bag-in-a-box" packaging system. The fitment connects the bag with a valve system and contains a removable diaphragm. The diaphragm is opened by operating a snaring tool which pulls on a tab to tear out the diaphragm. A method of assembling the device with the entire system is also disclosed.

7 Claims, 8 Drawing Sheets

FIG.3
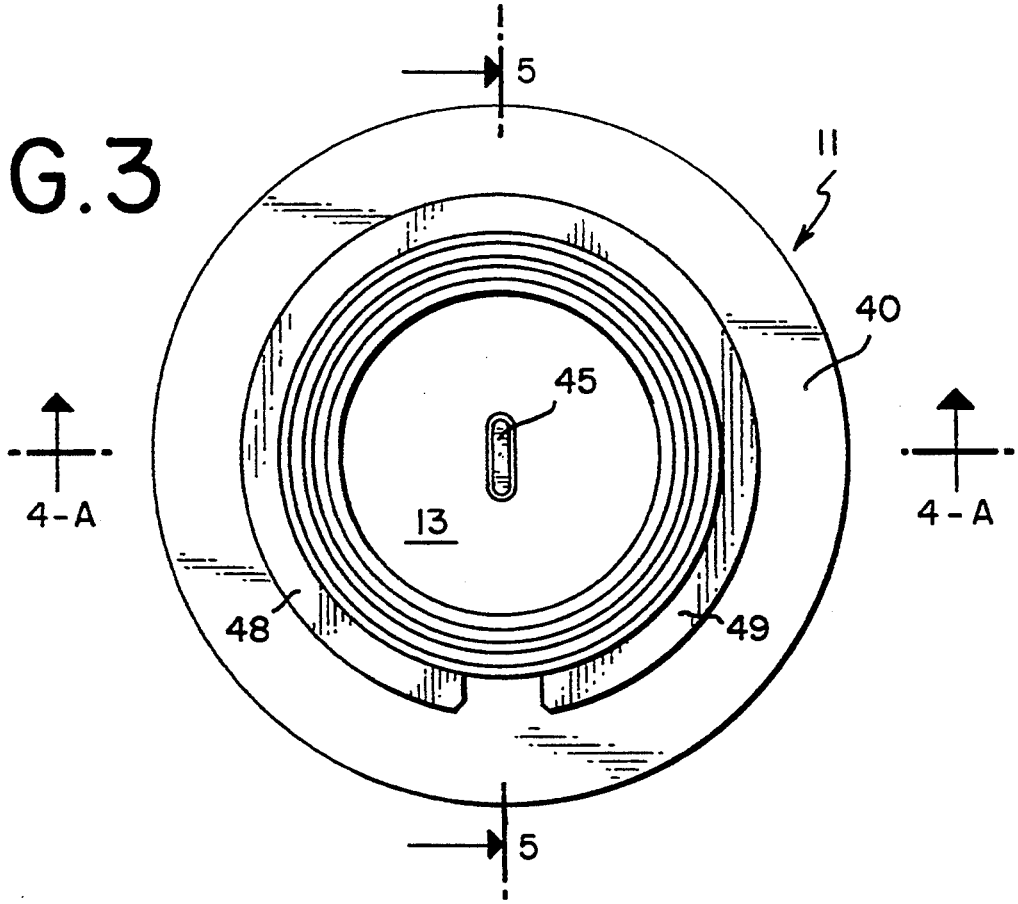
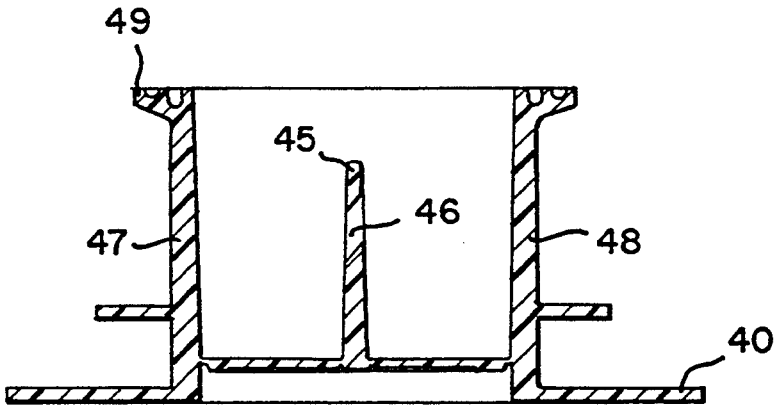
FIG.4-A

FIG.4-B
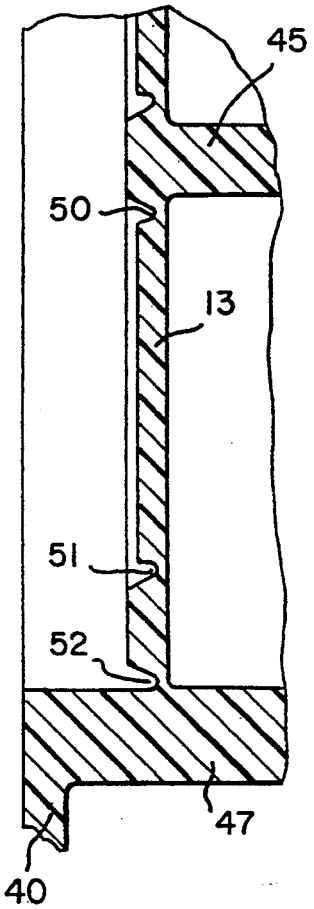
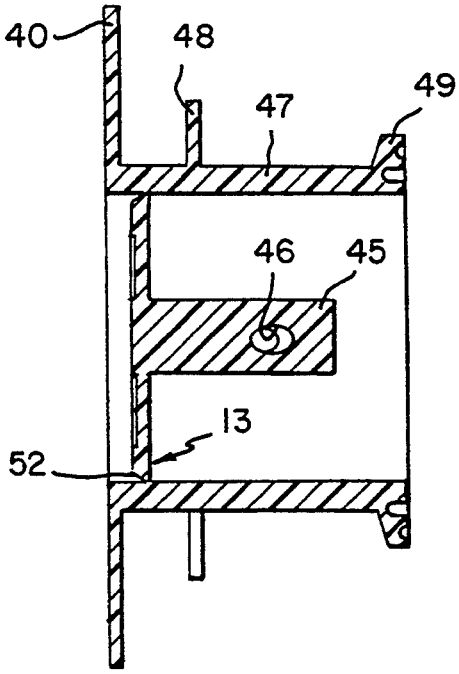
FIG.5
FIG.6
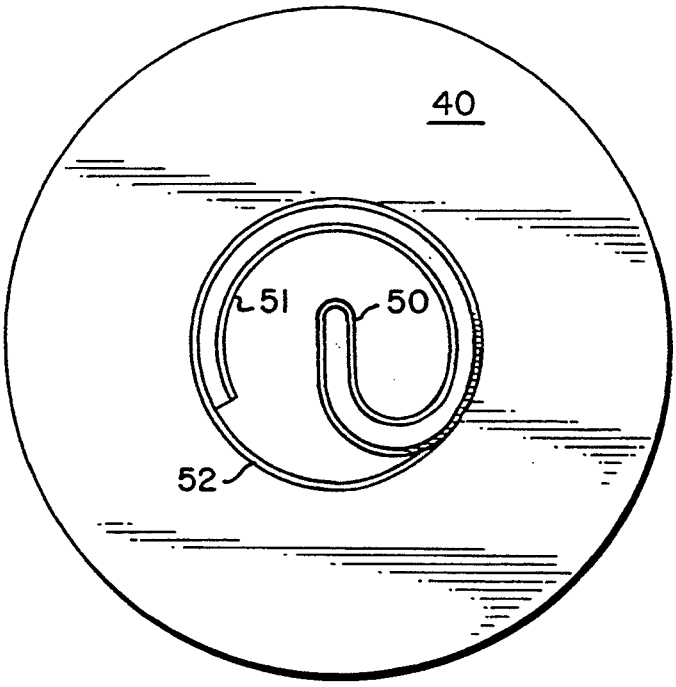

FIG. 7
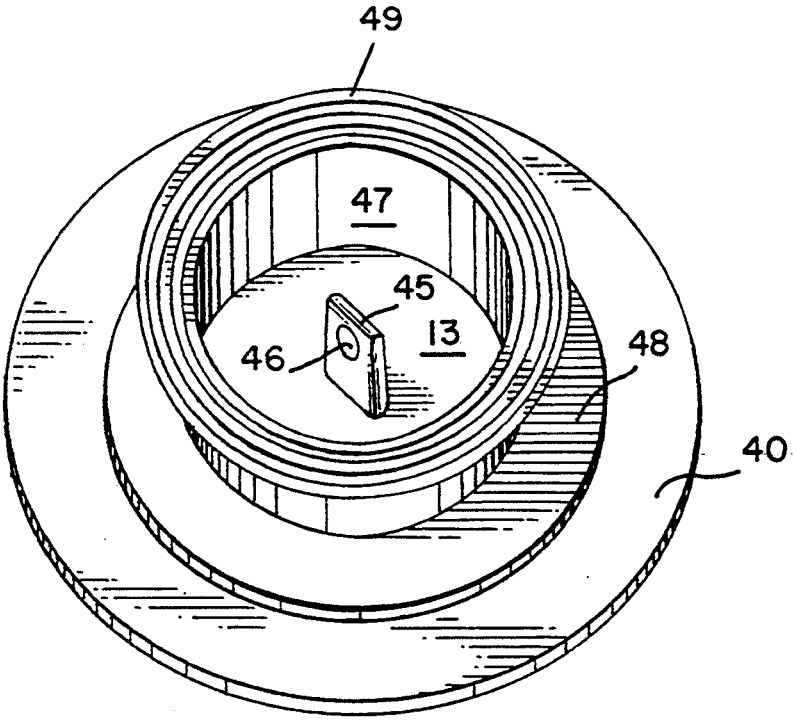
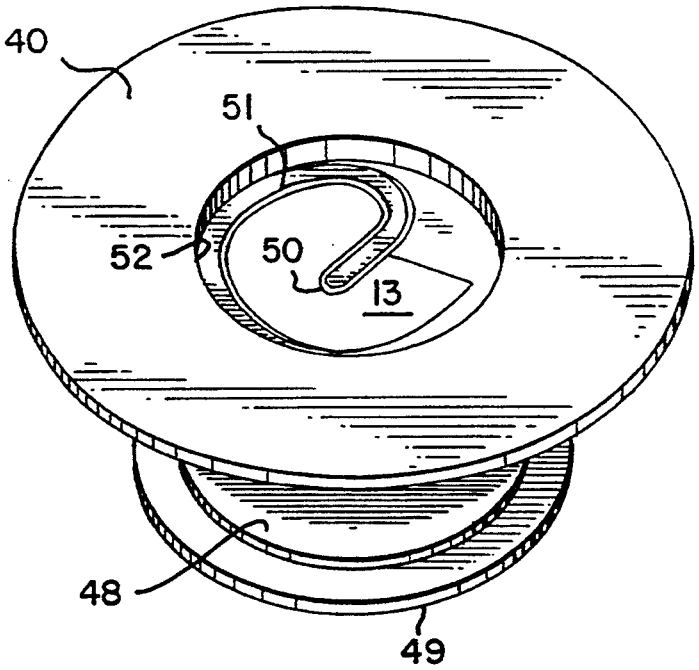
FIG. 8

APPARATUS AND METHOD TO PROVIDE BAG-IN-A-BOX SYSTEM

INTRODUCTION AND BACKGROUND

The present invention relates to an apparatus and method for providing a sterile "bag-in-a-box" filling and discharge system to enable the packaging, transportation, storage and utilization of fluid products such as pasteurized fruit juices and products, as well as yogurt and like materials of relatively high viscosity which must be handled under aseptic conditions.

Efforts have been made in the past to develop transportable, rust free stainless steel containers, commonly known as fluid contents containers, in which the fluid materials can be directly introduced. Such containers typically are of considerable size and may amount to 25 gallons and up or, expressed in terms of liters, containers of 100 to 1000 liters. However, these stainless steel containers are quite expensive and require a series of peripheral apparatus which must be repeatedly sterilized thereby adding to the cost of such systems. The prior art is familiar with flexible bulk bags in rigid holders or bins; i.e., "bag-in-a-box" technology, especially for the containerization of various food and pharmaceutical products. Typically such items as fruit juices, fruit based yogurt and the like are shipped in these boxes 75 which consist of an aseptic bag in a rigid frame work or container. The rigid container or "box" can be made of a suitable plastic such as polyethylene, polypropylene or the like. Also, cardboard or paper board boxes can be used. The use of the so called "bag-in-box" technology is the subject of a number of prior art publications such as shown in European patent application 0190757, German patent 35 03 916, German OLS 35 34 810 and OLS 36 15 063.

At present, the filling of such aseptic bags is accomplished by utilizing expensive auxiliary filling equipment. After filling, the containers can be stored aseptically with little or no refrigeration for an extended period of time. It is customary at the present time to accomplish dispensing of the bag contents by emptying the entire contents of the bag or utilizing expensive discharge equipment to permit reentry while maintaining asepsis of the bag. Normally, the container including the bag must remain attached to the unloading device until all the required product has been discharged.

It is an object of the present invention to overcome some of the problems associated with prior art apparatus and to facilitate the loading and unloading of sterilized and aseptic containers.

SUMMARY OF THE INVENTION

In achieving the above and other objects of the invention, one feature of the invention resides in a fitment device containing an openable diaphragm which is attached to the opening of a flexible bulk container, commonly called "a bag".

The bag and fitment are adapted to fit within a rigid container, or "box"; hence the term of art "bag-in-a-box". The fitment is arranged to fit the rigid container at the lower wall portion of the box which is at the point of filling with the fluid contents. The new fitment device facilitates maintaining the sterility and aseptic integrity of the interior of the bag. The fitment and flexible bag are connected to a valve or other suitable valve that can be used to fill the bag container with sterile contents, such as a food product. The same valve mechanism is then later used to dispense product in an aseptic system without necessarily discharging the entire contents. The flexible bulk containers or bag and the fitment device are integral parts of a nestable, aseptic bin system where the flexible bulk container, referred to herein as the "bag" is located in a bin or rigid framework (box) which permits the reuse of the bin and valve apparatus and the disposal or recycle of the used bag and fitment.

A further feature of the invention resides in a system for fitting together the fitment mechanism that is provided with a diaphragm seal with a re-usable stainless steel fill and discharge valve. The fitment device is fitted to the bag to provide for maintaining asepsis with respect to the interior of the bag. The entire unit comprising the bag, the rigid bin and the fitment device after being sterilized, is then fitted with a valve mechanism or similar valve. Steam sterilization can take place at that point. The diaphragm seal that is an integral part of the fitment device is then removed through the valve by a snaring tool. A filling apparatus containing the sterilized product is then fitted to the valve and is introduced into the sterilized bag container through the valve. The valve is then shut and the bag-in-a-box container is removed from the filling apparatus for storage or shipment.

The present invention provides a departure from previous designs because it enables the filling of empty sterile bags without the need for auxiliary filling equipment. The fitment device of the present invention permits the dispensing of any desired amount of product while maintaining asepsis of the package and contents. No auxiliary equipment for discharge is required. The fitment of the present invention permits the user to convert from the very expensive stainless steel tote shipping containers currently in use in the industry to far less expensive stackable, reusable plastic bins with aseptic bag liners.

BRIEF DESCRIPTION OF THE DRAWINGS

The invention will be further understood from the accompanying drawings, wherein:

FIG. 3 is a frontal elevational view of one embodiment of the fitment device of the present invention;

FIG. 4A is a sectional elevation view of the fitment device along the section line 4A—4A of FIG. 3;

FIG. 4B is a cross sectional view of the details of the diaphragm and its attachment to a fitment device of the invention;

FIG. 5 is a sectional elevation view taken along the line 5—5 in FIG. 3 showing a fitment of the invention;

FIG. 6 is a rearward elevational view of a fitment device of the present invention;

FIG. 7 is a perspective view of the front of a fitment device according to the present invention;

FIG. 8 is a perspective view of the rearward side of a fitment device of the present invention;

DETAILED DESCRIPTION OF THE INVENTION

Figure 1:
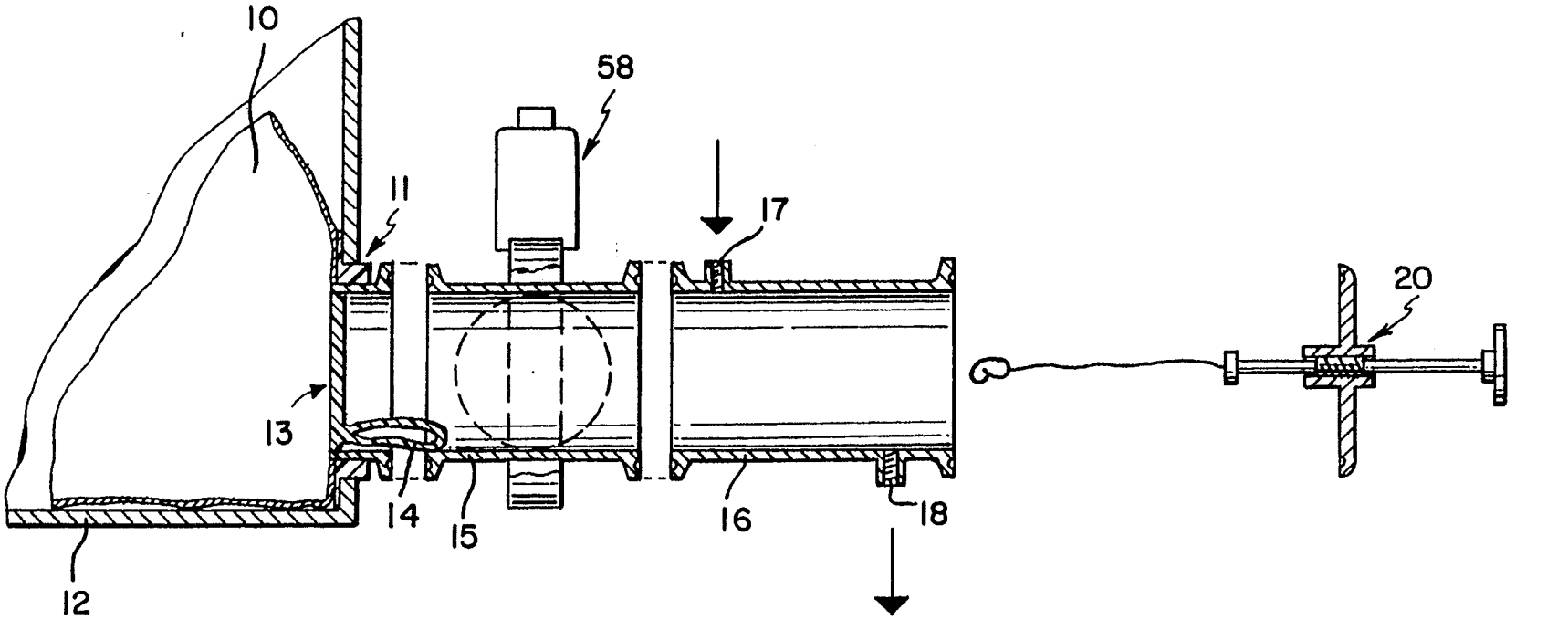
FIG. 1 is an exploded sectional elevation view of one embodiment of the apparatus of the present invention.

As shown in FIG. 1, the present invention relates to the method and apparatus for fitting an aseptic collapsible bag 10 into a rigid container 12 and the filling of the bag with a sterilized product such as food or pharmaceutical under conditions of asepsis. Pursuant thereto, the present invention provides a tubular fitment device 11 located at or near the bottom of a rigid container 12. The fitment includes a diaphragm 13 having an attached pull tab 14. Arranged to be clamped or otherwise removable attached to the fitment 11 is a valve 58 located in a tubular pipe section 15 adapted for conventional connection to a second tubular section 16, called a steam spool, which is equipped with ports 17 and 18 for the introduction of steam and the exiting of steam condensate, respectively. The steam spool is necessary for purposes of sterilization of the apparatus. A snaring tool 20 is provided which is adapted to be attached to the pull tab 14.

Figure 2:
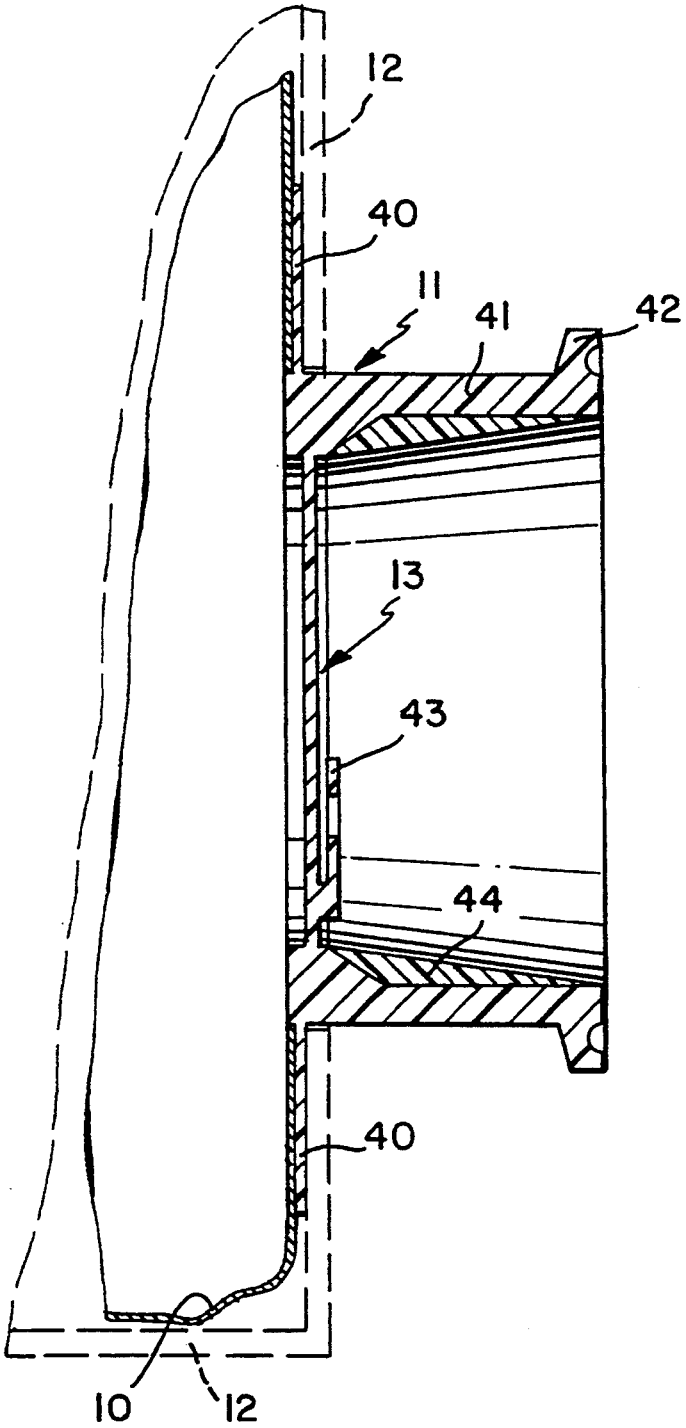
FIG. 2 is a sectional elevation view of the fitment embodiment of FIG. 1.

One embodiment shown in more detail in FIG. 2 depicts the fitment 11 of the invention conveniently located near the bottom portion of a suitable rigid container or bin 12 formed of paperboard or rigid plastic such as polypropylene or the like. The collapsible bag 10 is arranged within bin 12. An opening in bag 10 is aligned with the flange portion 40 of the fitment which fits inside of the opening in bin 12. The bag area near the opening is adhered to the flange 40 to secure the bag to the fitment. The throat section 41 of the fitment extends outside of the bin 12 and is adapted to be clamped or otherwise removably connected to an adjacent tubular member by suitable means such as a small flange end 42. Within the throat portion 41 of the fitment there is located diaphragm 13. As shown in FIG. 2, the diaphragm 13 is situated in the opening of the fitment nearest the bag 10. The diaphragm is constructed so as to be removable when pulled in the direction away from the bag opening. Score lines are provided on the diaphragm for this purpose. The diaphragm can be formed of any acceptable polymer, such as low density polyethylene, or other suitable material, and is fitted with a pull ring or tab 43. Portions 44 of the throat section 41 of the fitment 11 may be reinforced with additional plastic material for added strength. Because the fitment is subjected to steam for purposes of sterilization, it is necessary that the fitment be made of a temperature resistant polymer, such as high density polyethylene or other high temperature resistant polymer as will be apparent to those skilled in the art. However, the section of the fitment which is not necessarily subjected to steam, such as the flange 40 which is adhered to the bag material can be made of a material which has less resistance to temperature and is therefore less costly, such as a low density polyethylene or other less costly suitable material. The pull ring or tab 43 can also be formed of a somewhat flexible polymeric material such as polyethylene or the like. The fitment throat section 41 and connecting flange end 42 can be conveniently formed of an HDPE (high density polyethylene) or the like and molded to the shape of any common sanitary connection as shown in FIG. 2. LDPE (low density polyethylene) or other suitable material can be used to form the diaphragm 13 that is adapted to be removed and the bag mounting flange 40. HDPE or other strong and more temperature resistant material is desired for connection to the stainless steel valve typically used in the industry for filling purposes and also to withstand heat conduction during the sterilization operations.

The flange portion of the fitment 40 permits ease of heat sealing to the bag which is frequently made of low density polyethylene. After fabrication of the components of the fitment; i.e., the throat and the flange sections, the parts are welded or bonded together to form the composite fitment. When viewed from the front facing away from the bin container, the fitment of the invention is seen to be generally circular in shape; see FIG. 3. In this embodiment, the pull tab 45 is shown centrally located on the diaphragm 13.

A cross-sectional elevation view along lines 4—4 (FIG. 3) of the fitment according to an embodiment of the present invention is shown in FIG. 4A. In this view, the pull tab 45 has an opening 46 formed therein for attachment of the opening means which is the snaring tool (not shown). The tearable diaphragm 13 is off-set within the throat 47 a convenient distance, for example $\frac{1}{4}$ to $\frac{1}{2}$ inches to facilitate hooking up with the snaring tool. In this embodiment, in addition to the flange 40 for welding to the bag (not shown), a secondary flange 48 is provided which remains outside the bin and prevents the fitment from falling into the bin when the bag is empty and when the fitment is not connected to the valve.

End flange 49 is for removable attaching by conventional means to the valve (not shown).

FIG. 4B shows details of tab 46 where it attaches to the diaphragm 13. Score lines 50, 51, 52 on the back reverse side of diaphragm 13 enable the removal of the diaphragm by tearing away from the wall of the fitment 11.

FIG. 5 is a cross-sectional view along the section line 5—5 (FIG. 3) of the fitment showing the tab 45, which when pulled enables the tearing away and removal of the diaphragm 13. Hole 46 in the tab is for attachment to the snaring tool (not shown) and for tearing out and removing the diaphragm 13 so as to enable filling the contents of the bag after all of the component parts are assembled.

The rear view of the fitment is shown in FIG. 6 and reveals the score lines 50, 51, 52 which form the track of the travel of the tab when pulled to open and remove the diaphragm from the throat of the fitment. The initial zone of the tear out track score lines is located directly behind tab 46. Therefore, when the pull tab 46 is pulled, the tab breaks away initially at score line 50 and the tearing action continues in tracks 51 and finally reaches the circumferential score line 52 located at the perimeter of the diaphragm to enable complete removal.

FIG. 7 is a perspective view and shows a fitment of the present invention with the extending end flange member 49, throat section 47 and the diaphragm 13 with pull tab 45. Secondary flange 48 secures the fitment to the bin (not shown).

The rear view of the fitment of the invention is shown in FIG. 8 with the large flange 40 for heat sealing to the bag (not shown) and the diaphragm 13. The score line on the rear surface of the removable diaphragm are clearly indicated.

A variety of sanitary or aseptic valves commonly known in the art can be used for purposes of this invention. These can be manual or air operated. Examples of such valves are sold by GH Products Corp. of the Alfa- Laval Group. Persons skilled in the art will be able to select a suitable valve to match the purpose intended.

Figure 9:
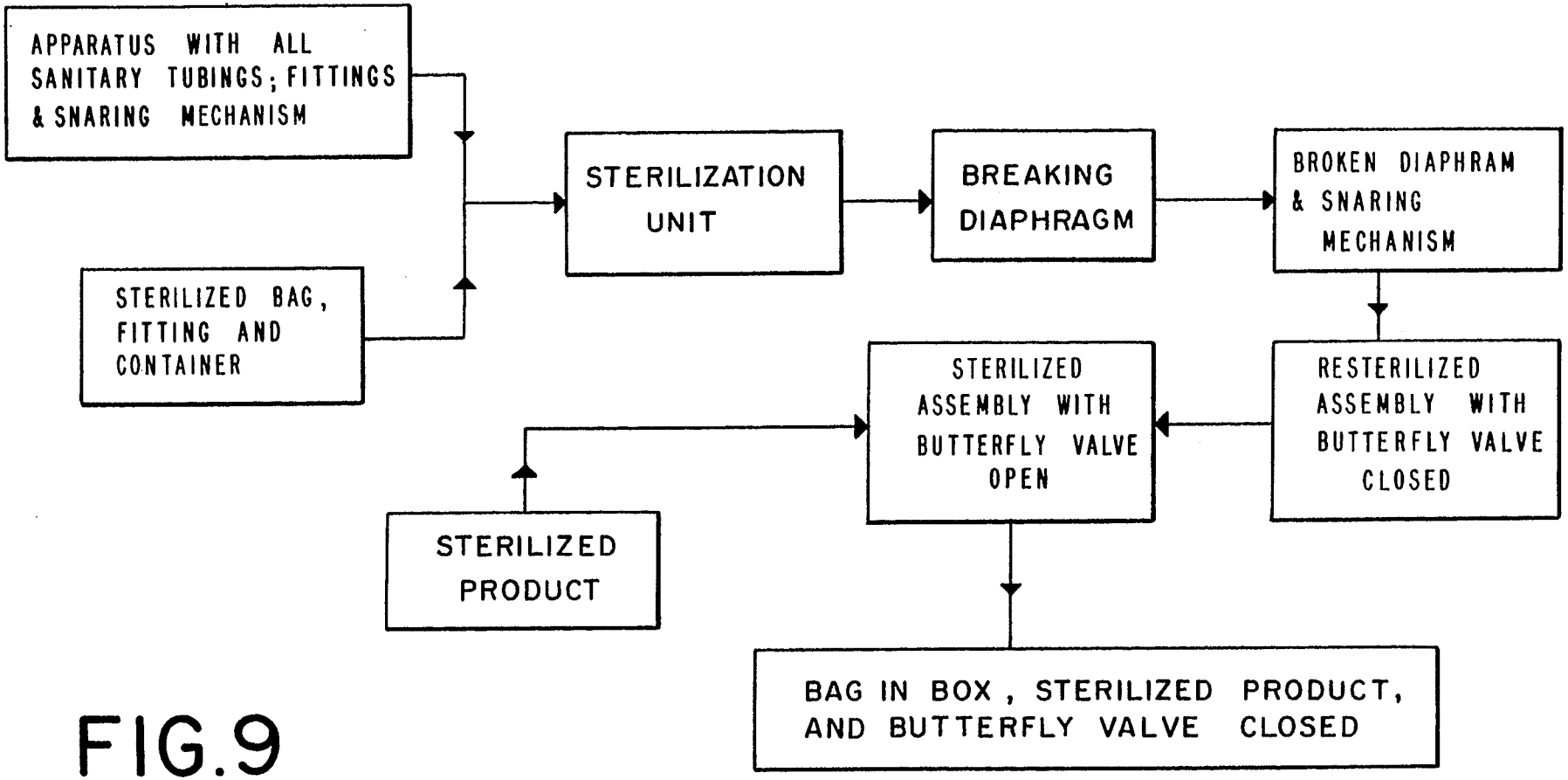
FIG. 9 is a flow diagram of the process of the present invention.

In carrying out the method of assembly of the apparatus of the invention there is shown in FIG. 9 the flow sequence whereby the bag-in-the-box with new fitment arrangement is prepared. In a first step, the fitment device, connected to the sterile empty flexible bag 10, is positioned in the rigid container 12. The diaphragm on the fitment bag acts as a seal for the bag and thereby maintains asepsis within the bag.

The empty bag and box with the fitment connected is then, in turn, connected to the valve and the steam spool and snaring tool. The free end of the snaring tool which can be a simple hook device is then hooked into the hole of the pull tab. The apparatus thus connected is then subjected to a steam sterilization by operating the steam spool. The inlet port is opened and the steam is introduced throughout the system of fitment and valve. Condensate exits through the condensate port. After a suitable time sufficient to achieve sterile conditions, the steam inlet port is closed.

Thereafter the snaring tool is operated to pull the tab and tear out the diaphragm thereby removing the seal between the bag 10 and the remainder of the apparatus. The valve is then closed.

The snaring device and torn out diaphragm are then removed and the equipment is resterilized with the valve closed. The sterilized bag-in-box is then subjected to the filling operation with the sterilized products such as yogurt fruit. The valve is then shut and the entire apparatus is removed from the filler apparatus for shipping or storage.

Figure 10:
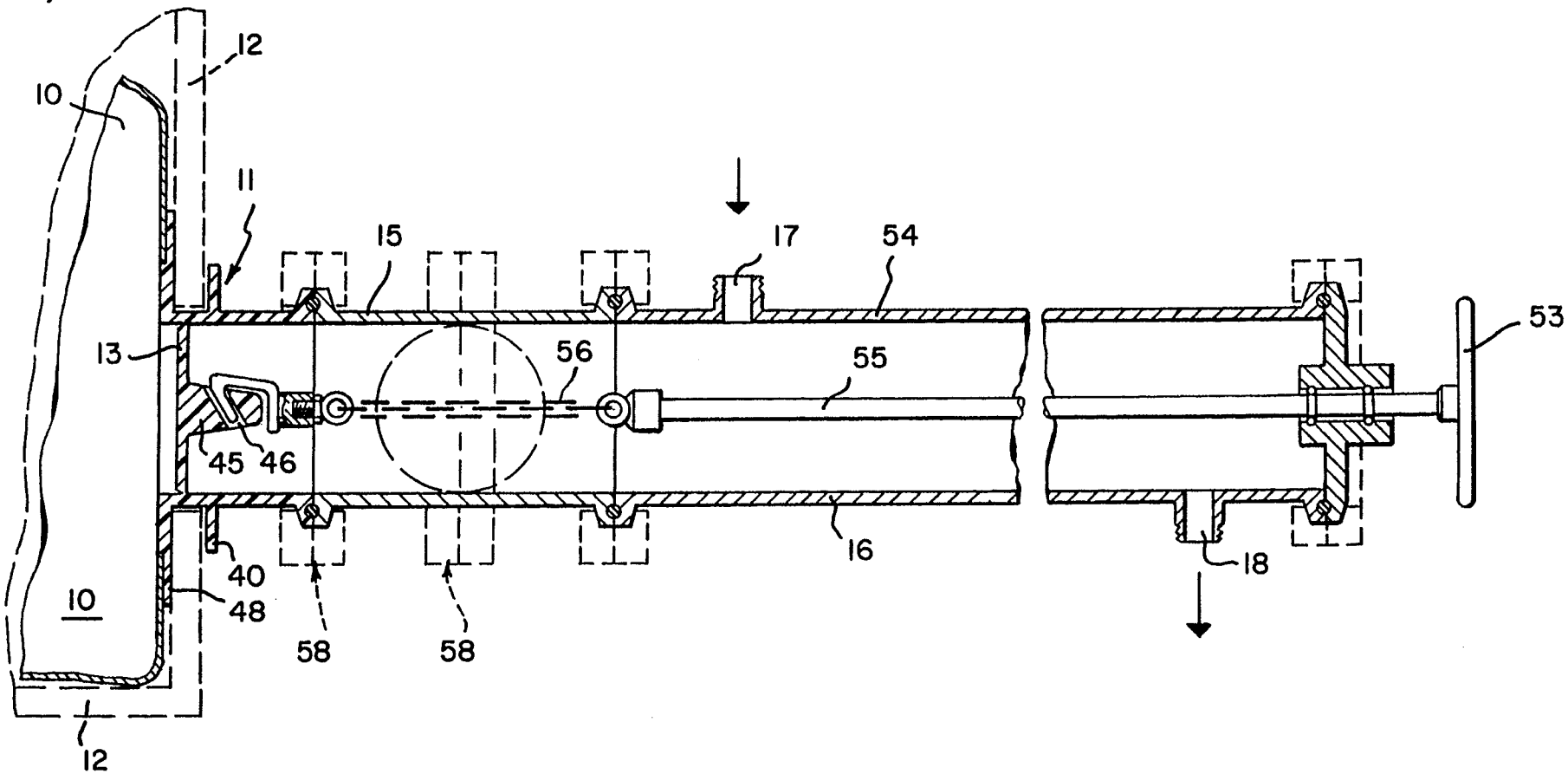
FIG. 10 is a cross sectional view of an apparatus according to the invention showing the pull handle snaring device, and snaring.

The operation of the snaring mechanism is shown in the embodiment of FIG. 10 which shows a simple pull handle 53 in a sanitary tube 54 where the pull handle is connected to the tab 45 of the diaphragm for opening and closing the bag-in-the-box.

The pull handle embodiment of FIG. 10 includes pull handle 53 attached to shank 55 which in turn is attached to a chain 56 passing through valve 58 and is connected to the tab 45.

Figure 11:
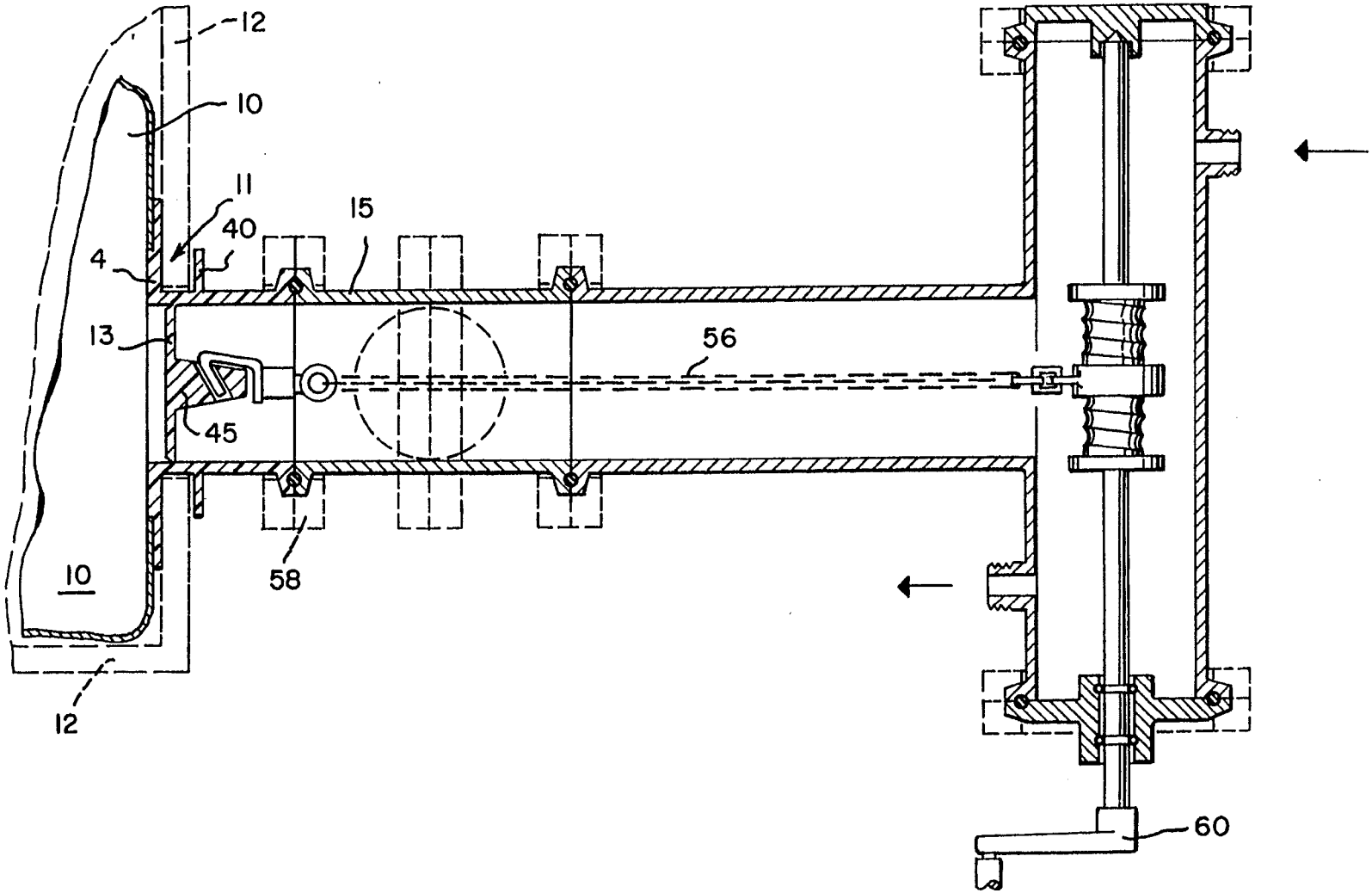
FIG. 11 is another embodiment of the snaring mechanism of the present invention.

In FIG. 11 the same apparatus is shown but with the alternative mechanism of a crank handle 60 for winding up the chain 56 for pulling and opening on the tab member.

The present invention can be carried out in many ways and an example of the method of the invention is described in further detail herein below.

The fitment 11 is welded onto the bag 10 and this combination is then sterilized. Typically the bags can be irradiated to sterilize the inside thereof. Once the sterilization is completed, then everything to the left of the fitment 11 shown in FIG. 1 is sterilized. The bag is fitted into the bin in a collapsed state so that it can be properly set in the bottom of the rigid container 12 in such a way that it will not fall out or fall inside the bin. Conveniently, at this point, the valve unit 58 which is attached to the tubular pipe section 15 is then connected by conventional means to the steam unit 16. After coupling of these two tubular sections, it may be convenient to then attach the snaring device 20 through suitable clamps or bolt means to the steam conduit 16. The units are assembled such that the snaring tool extends into the tubular sections 15 and 16 and through a suitable opening in valve 58. All components are then clamped and connected in place. The snaring tool extends into the fitment 11 and the operator would attach the end of the snaring tool to the pull ring or tab 14. After that, the fitment is clamped or bolted or otherwise connected by conventional means to unit 15. After connection of all tubular members, the steam source is hooked up to steam entrance port 17 and steam is turned on to sterilize the entire chamber including the fitment, the tubular member 15, the snaring tool and the tubular member 16. Condensate is drained from exit port 18. After a suitable period of time sufficient to achieve sterilization, the steam is turned off and the snaring tool is pulled to tear the diaphragm at the tab member and pull the diaphragm completely through the valve and the steam spool section. Since the diaphragm is made of flexible material, it can be readily pulled through the apparatus for removal. This operation then opens the bag 10 to the fitment device and the valve which is then shut to close the bag opening. At this point, steam spool 16 can be disconnected from member 15. The combination of the bin 12, bag 10 and valve 58 is thereby rendered aseptic and can be closed. This combination can then be shipped to any location for mounting on a pipe and connected to another steam spool so that the other side of the pipe is then steamed to sterilize the chamber. The valve can then be opened to fill the contents of the bag with the sterile product. Thus the steam spool can be resterilized and also the product valve can be sterilized.

Further variations and modifications of the foregoing invention will be apparent to those skilled in the art and are intended to be encompassed by the claims appended hereto.

I claim:

1. An apparatus for the packaging of a sterilized fluid product comprising a fitment having a throat section, a flange located at a first end of said throat section, a diaphragm section removably attached in said throat section and proximate said first end, said diaphragm being fitted with a pull tab member, the diaphragm being provided with score lines permitting the tab member to be pulled for controllably cutting said diaphragm along said score lines thereby enabling said diaphragm to be removed from said throat section, said throat section terminating at a second end in a second flange member, said second flange member being removably attached to valve means for supplying and dispensing said product, said valve means being attached to a tubular member which is a steam spool section, snaring means for connecting to said tab member and being attached to said steam spool section, said snaring means comprising a handle and a flexible member being removably connected to said tab member in said throat section to thereby enable pulling said tab member to thereby remove said diaphragm, the opposite end of said flexible member being attached to said handle section of said snaring means, said handle being movable and for causing said snaring means to pull on said tab member thereby tearing the diaphragm and being of capable of removing said diaphragm from said throat section of said fitment means.

2. The apparatus of claim 1 wherein said throat section has attached thereto third flange member means for accommodating and fitting a wall section of a rigid container means for holding a flexible bag.

3. The apparatus of claim 1 further comprising rigid container means for holding a flexible bag and adapted to have said fitment pass through an opening in said container so as to enable said throat section to be pass out through said opening to enable attachment to said valve means.

4. The apparatus of claim 1 further comprising a flexible bag member attached to the apparatus.

5. The article of claim 4 which further contains a liquid or fluid food product under sterile conditions in said bag.

6. A method of equipping a flexible bag member with fitment means for filling of said bag under sterilized conditions comprising assembling rigid container means for holding a flexible bag with a flexible bag member having an opening by welding said fitment means onto said opening of said bag member at a flange member attached to said fitment means, said fitment means having a removable diaphragm, attaching valve means for supplying and dispensing a fluid product to said fitment means, attaching snaring means for removing said diaphragm to said valve means and to said diaphragm, removing said diaphragm and subjecting said fitment to sterilizing agents with the valve means closed, introducing into said sterilized bag a sterilized product from a filling apparatus through the valve means, shutting the valve means and removing the container from said filling apparatus.

7. A method for providing a sterilized bag in box container comprising providing a flexible bag made of flexible polymeric film and welding said bag onto a tubular fitment means for attaching to said bag such that an opening in said bag is aligned with a removable diaphragm means for creating an opening in said fitment means fitting the bag and said fitment means into a rigid container therefor, connecting said fitment means to a valve means for supplying and dispensing a fluid product through a removable attachment means for connecting said fitment to said valve means, attaching said valve means in a removable manner to a tubular steam spool means for sterilizing said fitment means attaching a snaring means for attachment to said diaphragm means to said steam spool and passing said snaring means through said steam spool means and said valve means into said fitment means and attaching said snaring means to a tab member, for attaching to said snaring means, located on said diaphragm means in said fitment means, introducing steam into said steam spool means, to sterilize said fitment means, discontinuing the supply of steam and operating the snaring means so as to pull on said tab member thereby tearing the diaphragm along score lines to thereby remove the entire diaphragm from said fitment and to provide a connection between said bag and said fitment means, thereafter closing said valve means and removing said snaring means, introducing steam in said steam spool means to sterilize an opening side of said valve means, therafter attaching said valve means to a source of sterilized product, opening said valve means and introducing said sterilized product into said bag, thereafter when said bag is filled with said sterilized product, closing said valve means and removing said container from said source of product.

* * * * *